United States Patent [19]

Pohle

[11] 4,182,290

[45] Jan. 8, 1980

[54] VARIABLE RATIO ROCKER ARM

[76] Inventor: William A. Pohle, P.O. Box 684, Hallandale, Fla. 33009

[21] Appl. No.: 918,061

[22] Filed: Jun. 22, 1978

[51] Int. Cl.[2] ..... F01L 1/18

[52] U.S. Cl. ..... 123/90.39; 123/90.45; 74/519

[58] Field of Search ..... 123/90.39, 90.41, 90.42, 123/90.43, 90.45, 90.46, 90.47, 90.15, 90.16, 90.36; 74/519, 559

[56] References Cited

U.S. PATENT DOCUMENTS

| | | | |
|---|---|---|---|
| 1,395,851 | 11/1921 | McLean | 123/90.39 |
| 1,455,447 | 5/1923 | Ochs | 74/519 |
| 1,654,020 | 12/1927 | Schmidt | 123/90.39 |
| 1,967,918 | 7/1934 | Wells et al. | 74/519 |
| 2,322,173 | 6/1943 | Spencer | 74/559 |
| 3,189,011 | 6/1965 | Briggs | 123/90.45 |
| 3,251,350 | 5/1966 | Thompson | 123/90.41 |
| 3,911,879 | 10/1975 | Altmann | 123/90.39 |
| 4,077,369 | 3/1978 | Buehner | 123/90.39 |

FOREIGN PATENT DOCUMENTS

| | | | |
|---|---|---|---|
| 733651 | 3/1943 | Fed. Rep. of Germany | 123/90.39 |

*Primary Examiner*—Charles J. Myhre
*Assistant Examiner*—Jeffrey L. Yates
*Attorney, Agent, or Firm*—Crickenberger and Moore

[57] ABSTRACT

The amount of lift of a valve lifter rocker arm is determined by a rotatably mounted valve pushrod seat having an eccentrically positioned depression for receiving the pushrod end. The seat is rotatably adjusted to one of two predetermined positions to increase or decrease the leverage ratio of the rocker arm. A screwdriver slot in the seat member permits easy adjustment without removing the rocker arm, and a set screw locks the seat member in the desired position.

5 Claims, 4 Drawing Figures

VARIABLE RATIO ROCKER ARM

BACKGROUND OF THE INVENTION

In high performance internal combustion engines, it is frequently desirable to have the capability of changing the valve lifter rocker arm leverage ratio to adapt engine performance to suit certain atmospheric conditions and physical characteristics of the racetracks. It is common practice to accomplish this change by the physical substitution of an entire rocker arm having the desired leverage ratio, a procedure which is costly from the standpoint of both time and money.

There have been attempts in the past to vary the ratio of the lengths of rocker arms in valve lifter mechanisms to increase the lift obtainable. One structure for doing this is shown in U.S. Pat. No. 1,654,020 to B. F. Schmidt. The Schmidt device utilizes complementary mating surfaces on the rocker arm and pushrod end to produce a rolling contact which changes the effective rocker arm ratio in a predetermined variable fashion in accordance with the vertical motion of the pushrod. A screw thread adjustment of the pushrod length is provided.

SUMMARY OF THE INVENTION

The present invention is directed to the problem of changing the valve lifter rocker arm leverage ratio in the operation of an internal combustion engine without substituting a different rocker arm and by using the simplest and most trouble-free mechanism. The desired results are obtained in a rocker arm construction in which one end of the rocker arm is counterbored to receive a rotatable seat member which is held in one of two stationary positions by a set screw. The seat member has an eccentrically positioned depression which receives the pushrod end and establishes the rocker arm leverage ratio. By rotating the seat member from one stationary position to the other the effective length of one end of the rocker arm can be shortened or lengthened as desired, thereby changing the rocker arm leverage ratio.

DESCRIPTION OF THE PREFERRED EMBODIMENT

Figure 1:
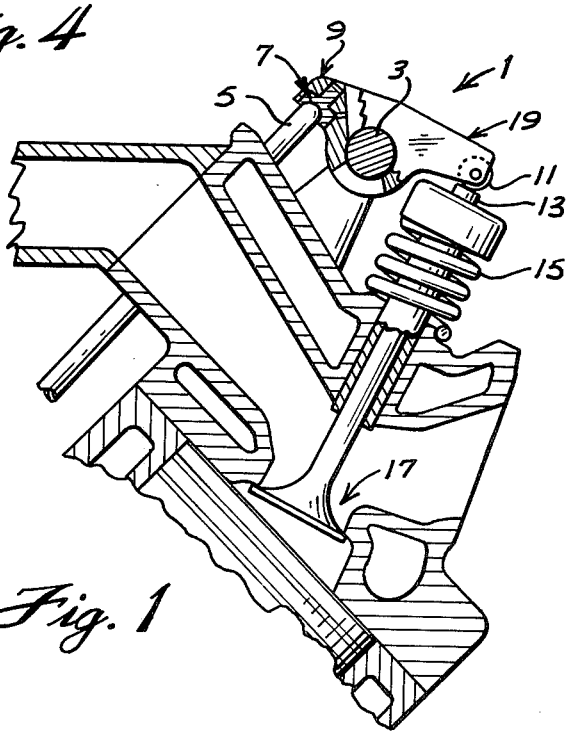
FIG. 1 is a cross-sectional view of a portion of an internal combustion engine showing the valve lifter arm construction of the present invention in operating position.

FIG. 1 of the drawings shows the invention as it is employed in an internal combustion engine structure. A rocker arm 1 is mounted on shaft 3 for oscillating motion therearound. Pushrod 5 acts against the seat member 7 which is rotatably adjustable and which is mounted in end 9 of rocker arm 1. Upward movement of pushrod 5 causes roller 11 to force valve stem 13 downward against the action of valve spring 15 to open valve port 17. The ratio of the effective length of end 9 to end 19 of rocker arm 1 determines the operating force required and the amount of valve lift available. The pushrod seat member 7 is constructed so that the effective length of end 9 can be changed by a simple adjustment.

Figure 3:
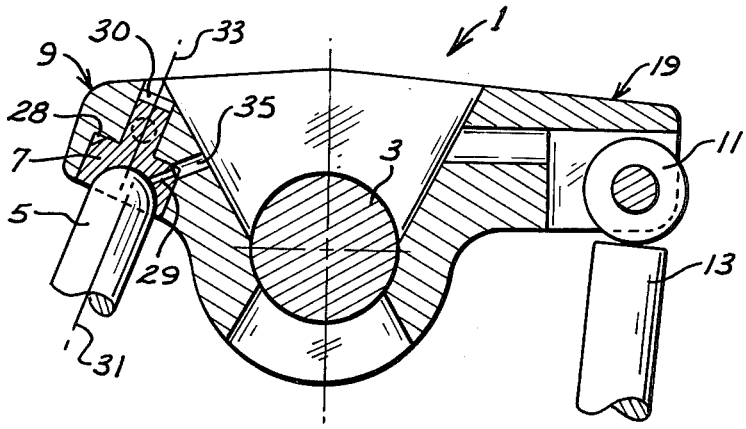
FIG. 3 is a cross-sectional view of the rocker arm assembly showing the pushrod seat member in the shorter effective arm length position.
Figure 2:
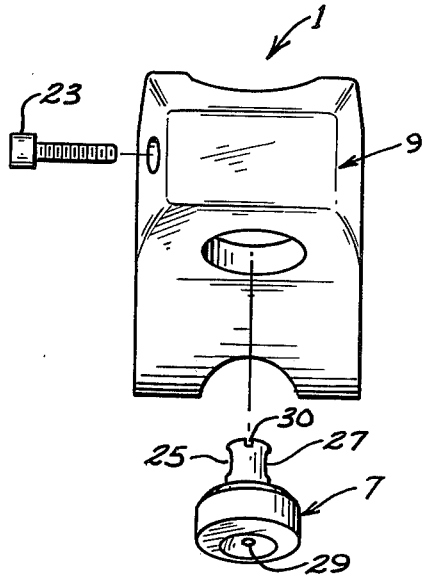
FIG. 2 is an exploded perspective view of one end of the rocker arm showing the pushrod seat member and the locking set screw.
Figure 4:
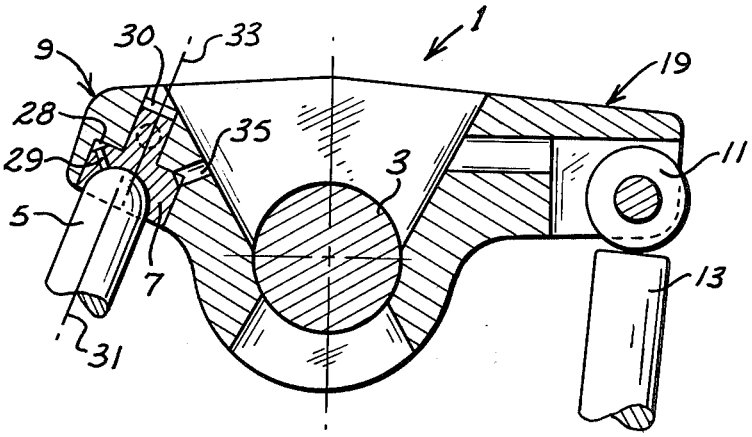
FIG. 4 is a cross-sectional view of the rocker arm assembly showing the pushrod seat member in the longer effective arm length position.

FIG. 2 is an exploded perspective view of end 9 of rocker arm 1 showing the location of depression 21 in seat member 7, which receives the end of pushrod 5. Set screw 23 locks seat member 7 in place in end 9 by bearing against either of the flat surfaces 25 or 27. Oil passageways 28 and 29 are provided to facilitate lubrication as illustrated in FIGS. 3 and 4. Oil passageway 28 is formed by chamfering the edge of seat member 7 to form a circumferential passageway between seat member 7 and the wall of the counterbore in rocker arm 1.

FIGS. 3 and 4 show the rocker arm 1 in substantially the same position, but with different leverage ratios. As shown in FIG. 3 the seat member 7 has been adjusted by the simple expedient of being turned by hand with a screwdriver placed in a screwdriver slot 30 in the top of seat member 7 so that the centerline axis 31 of pushrod 5 is between shaft 3 and the centerline axis 33 of seat member 7. Set screw 23 bears against flat surface 25 (as shown in FIG. 2) to hold the seat member 7 in this position to obtain maximum valve lift.

FIG. 4 shows the position of seat member 7 for minimum valve lift. In this position the centerline 31 of pushrod 5 is furthest from shaft 3. In either position continuous lubrication is made possible by means of oil passageways 28 and 29, since passageway 28 is always in communication with oil passageway 35 in rocker arm 1. Adjustment to the positions of maximum or minimum lift is accomplished easily and conveniently by loosening the set screw 23, turning seat member 7 to the desired position, and then tightening set screw 23 to hold the selected position.

What is claimed is:

1. In a valve lifter rocker arm structure for mounting upon a shaft for oscillatory motion around said shaft wherein end portions of said rocker arm structure extend on either side of said shaft and one of said end portions has means for engaging and lifting the valve of an internal combustion engine, the combination comprising a seat member rotatably mounted in the other end portion of said rocker arm structure, said seat member having a depression eccentrically located therein for receiving and seating a conventional pushrod to operate said rocker arm structure, and means for locking said seat member in a desired position, whereby the effective length of said other end portion of the rocker arm structure may be either of two preselected values in accordance with the position of said eccentrically located depression.

2. The combination according to claim 1 wherein said seat member has a screwdriver slot therein for rotatable adjustment.

3. The combination according to claim 2 wherein said rocker arm structure has a set screw mounted therein to engage flat surfaces on said seat member and lock it in position.

4. The combination according to claim 3 wherein said seat member has at least one oil passageway therein.

5. The combination according to claim 4 wherein said seat member has a chamfered edge which forms a portion of an oil passageway in said rocker arm structure.

* * * * *